US005692608A

United States Patent [19]

Simien

[11] Patent Number: 5,692,608

[45] Date of Patent: Dec. 2, 1997

[54] REMOTE CONTROL CADDY

[76] Inventor: Cynthia Simien, 132 Vivian Dr., Lafayette, La. 70508

[21] Appl. No.: 651,696

[22] Filed: May 21, 1996

[51] Int. Cl.[6] ..... B65D 85/00

[52] U.S. Cl. ..... 206/320; 383/38; 383/39; 383/119; 211/13

[58] Field of Search ..... 206/305, 320, 206/376, 377; 383/38, 39, 40, 107, 119; 150/146; 248/205.2, 309.1; 211/13

[56] References Cited

U.S. PATENT DOCUMENTS

| | | | |
|---|---|---|---|
| Re. 19,189 | 5/1934 | Ottinger | 383/38 |
| 1,656,339 | 1/1928 | Runyan | 383/38 |
| 1,663,388 | 3/1928 | Rona | 383/38 |
| 1,850,920 | 3/1932 | Calkins | 383/38 |
| 2,458,567 | 1/1949 | Cramer | 383/38 |
| 2,507,842 | 5/1950 | Waddill | 383/39 |
| 2,532,517 | 12/1950 | Schwartzman | 383/39 |
| 2,757,699 | 8/1956 | Fancher et al. | 383/38 |
| 3,187,903 | 6/1965 | Oltz | 383/38 |
| 3,717,188 | 2/1973 | Green | 383/39 |
| 3,967,666 | 7/1976 | Farrar | 383/39 |
| 4,858,763 | 8/1989 | Scott | 383/40 |
| 4,949,843 | 8/1990 | Stokes | 206/305 |
| 5,009,189 | 4/1991 | Neff | 383/119 |
| 5,096,149 | 3/1992 | Riese | 248/216.1 |
| 5,377,833 | 1/1995 | Ranger | 383/38 |

*Primary Examiner*—David T. Fidei

*Attorney, Agent, or Firm*—C. Dean Domingue; Robert L. Waddell

[57] ABSTRACT

A remote control caddy which is detachably affixed to a sofa or chair and has one or more pockets for the placement and storage of remote control devices, such as t.v. or stereo remote control units. The remote control caddy is made of upholstery fabric, lined with an upholstery fabric liner, which preferably matches the fabric of the sofa or chair to which it is affixed.

5 Claims, 6 Drawing Sheets

REMOTE CONTROL CADDY

FIELD OF THE INVENTION

The present invention relates to a remote control caddy and in particular, a remote control caddy which is detachably affixed to a sofa or chair and has one or more pockets for the placement and storage of remote control devices, such as t.v. or stereo remote control units.

BACKGROUND OF THE INVENTION

Many of today's home electronic equipment is operated externally through the use of remote control devices. Remote control devices, often referred to as "clickers", predominate our lives. We use them to operate our television sets, stereo receivers, cd players, vcrs and cable boxes. It is not uncommon for a person to have as many as five different remote control devices present in the home.

Keeping track of the various remote control devices continues to be a problem. Often the devices are scattered about the living room or den in various locations making it difficult to find them. For example, the t.v. remote control device may be sitting on the coffee table, while the vcr and stereo remote control devices are located in different areas of the room, such as on a shelf of an entertainment center or even on the floor. In order to use the devices, they must first be located, often a rigorous undertaking requiring the assistance of all family members. This is an unnecessary, frustrating and time consuming task.

What is needed to solve this problem is an apparatus which can be situated in a central location in the living room or den to receive and store the various remote control devices. The apparatus should be relatively inexpensive to manufacture and be of such shape and size as to blend into the decor of the living room or den. These objects are achieved by the remote control caddy of the present invention.

SUMMARY OF THE INVENTION

The present invention solves the problems associated with the misplacement of remote control devices by providing a remote control caddy which is detachably affixed to a sofa or chair and has one or more pockets for the placement and storage of remote control devices, such t.v. or stereo remote control units.

The remote control caddy of the present invention is made of upholstery fabric and upholstery fabric liner. Hence, its construction is relatively inexpensive, merely requiring the cutting and sewing together of essentially two main components: (1) a bottom panel and associated liner and (2) a top panel and associated liner. The top panel forms the pocket for placement and storage of one or more remote control devices. The pocket may be divided into separate compartments or pockets which individually receive and store the remote control devices.

The remote control caddy of the present invention is designed to be detachably affixed to a sofa or couch, which items are commonly found in the living room or den where the electronic equipment is situated. Often, the sofa or chairs are centrally positioned within the living room or den and are used by the occupant of the home while viewing t.v or listening to the stereo. Hence, by associating the remote control caddy with a sofa or chair, a convenient and central location for the storage of the remote control devices is achieved. Moreover, the upholstery fabric composition of the remote control caddy of the present invention has the added advantage of blending with the existing furniture thereby creating an esthetically pleasing addition to the room. This is even more pronounced when the fabric material of the remote control caddy matches the fabric of the sofa or chair.

The placement of the remote control caddy of the present invention about a sofa or chair is done so for ease of economy and convenience of the person sitting therein who may be using remote controlled electronic equipment. For example, the top portion of the remote control caddy of the present invention may be affixed to the seat portion of the sofa or chair, beneath the seat cushions of the sofa or chair, with the lower portion of the caddy containing the pocket(s) allowed to hang down about the skirt of the sofa or chair. In this position, a person merely has to reach down from his or her seated position on the sofa or chair to obtain a remote control device. Alternatively, the top portion of the remote control caddy can be affixed to the top of an arm of the sofa or chair with the lower portion of the caddy containing the pocket(s) permitted to hang down about the outer side of the arm. In this configuration, a person merely has to reach over the arm of the sofa or chair to obtain a remote control device.

Because of the detachable feature of the remote control caddy of the present invention, the caddy can easily be relocated to different positions of the sofa or chair, or to different sofas or chairs within the home, depending upon the desire of the occupant. An additional advantage resulting from the detachable feature of the remote control caddy, is the capability of removing the caddy from the sofa or chair in order to clean it.

DETAILED DESCRIPTION OF THE PREFERRED EMBODIMENTS

Figure 1:
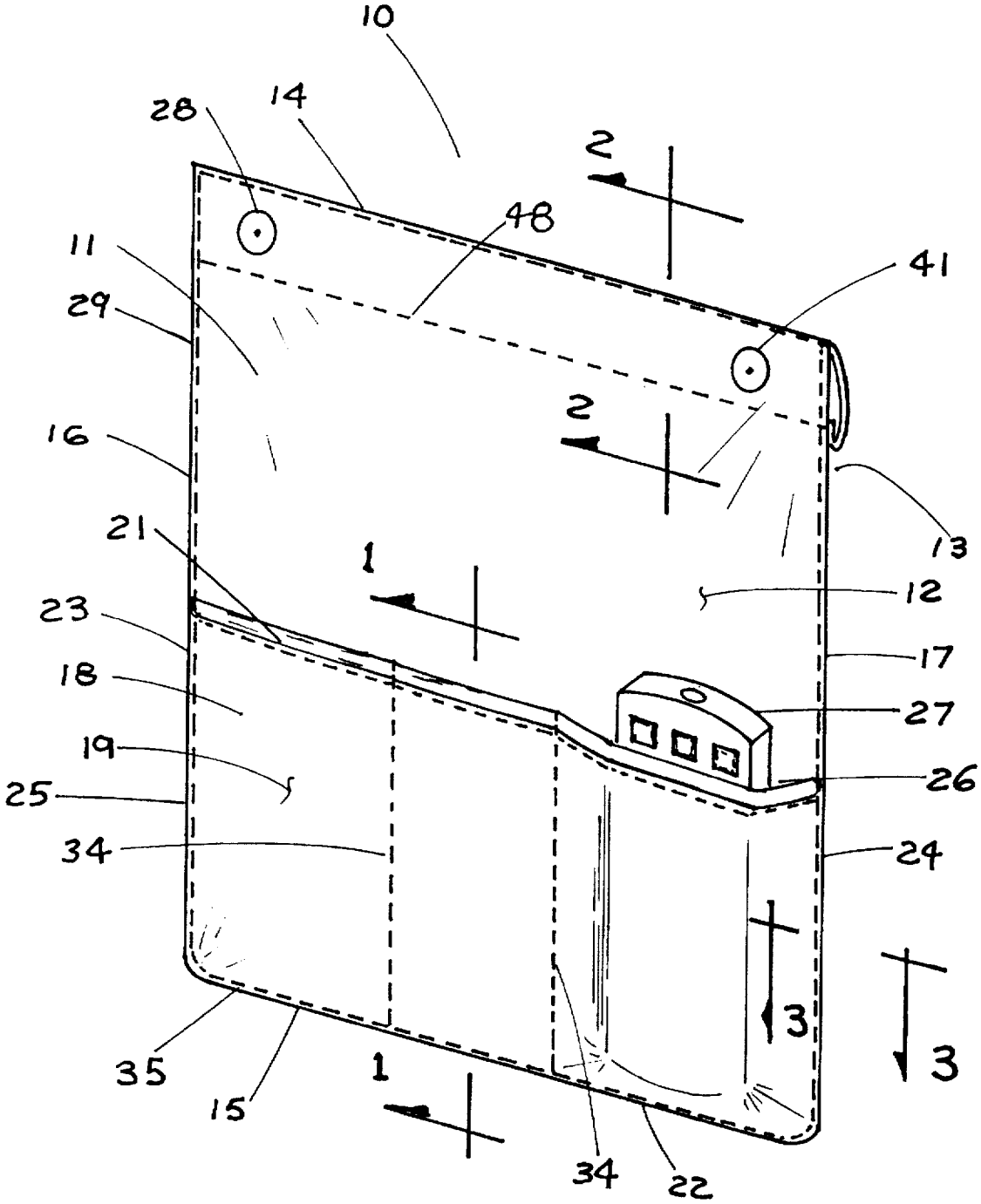
FIG. 1 is an isometric view of one embodiment of the remote control caddy of the present invention.
Figure 4:
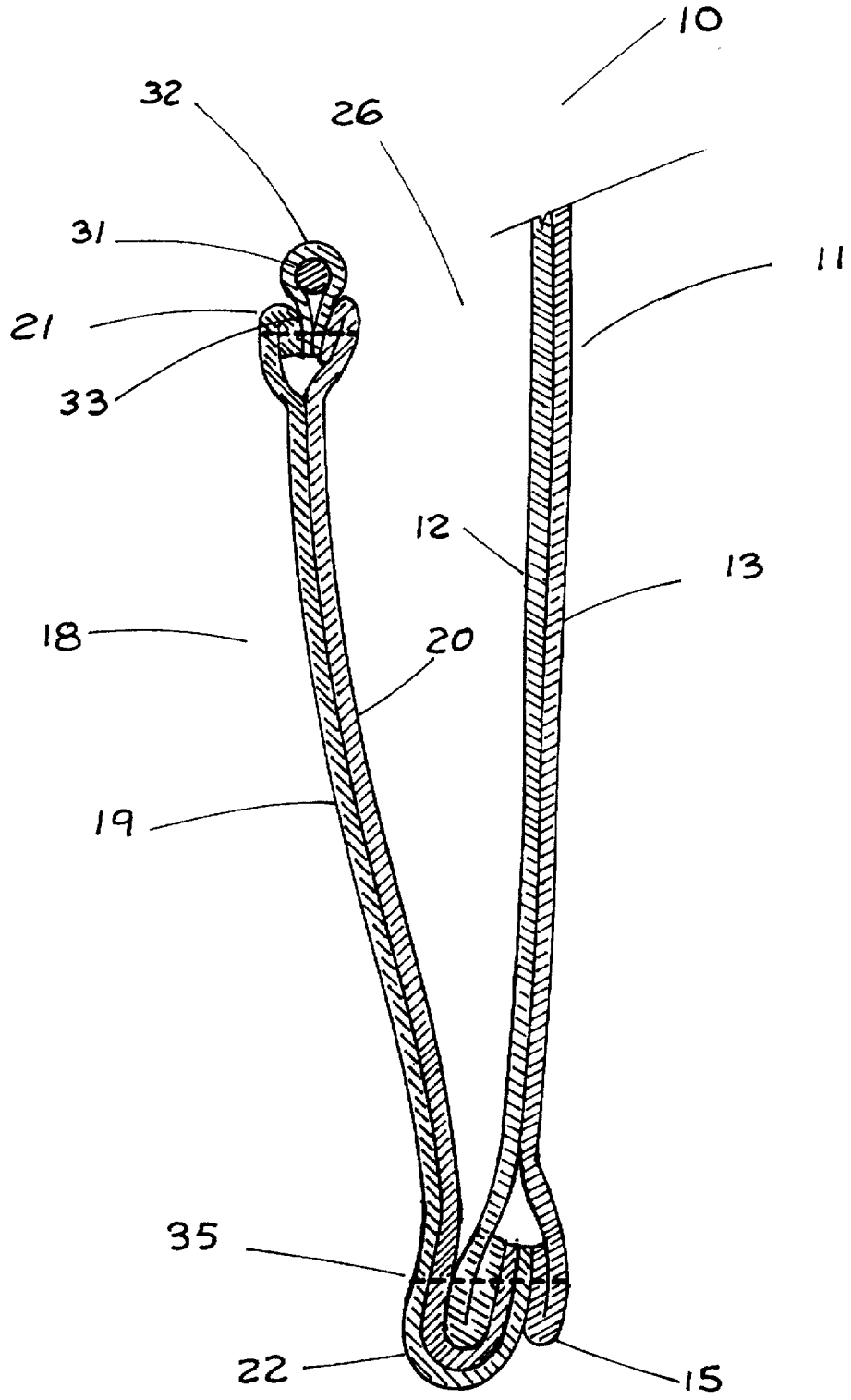
FIG. 4 is a partial cross sectional, isometric view of one embodiment of the remote control caddy of the present invention taken along line 1—1 of FIG. 1 showing the placement and construction of the cording material.

With reference to the figures where like elements have been given like numerical designation to facilitate an understanding of the present invention, and particularly with reference to the embodiment of the remote control caddy of the present invention illustrated in FIGS. 1 and 4, the remote control caddy 10 may include a bottom panel 11. Bottom panel 11 may have a top layer 12 made preferably of an upholstery fabric material and a bottom layer 13 made preferably of a fabric liner. Bottom panel 11 preferably conforms generally to a shape of a rectangle or square having a top edge 14, a bottom edge 15 and side edges 16, 17.

Again with reference to FIGS. 1 and 4, remote caddy 10 may also have a top panel 18. Top panel 18 may have a top layer 19 made preferably of an upholstery fabric material and a bottom layer 20 made preferably of a fabric liner. Top panel 18 preferably conforms generally to a shape of a rectangle or square having a top edge 21, a bottom edge 22 and side edges 23, 24.

As further shown in FIG. 1, top panel 18 may be secured to lower portion 25 of bottom panel 11. Preferably, top panel 18 is secured along bottom edge 15 of bottom panel 11 and more preferably, along the entirety of bottom panel 15. Top panel 18 may also be secured to bottom panel 11 partially along side edges 16, 17. Hence, side edges 23, 24 of top panel 18 are preferably completely secured to a portion of side edges 16, 17 of bottom panel 11.

As best seen in FIG. 1, top panel 18 may be secured to lower portion 25 of bottom panel 11 by stitching 35. Stitching 35 preferably runs along and attaches bottom edge 22 of top panel 18 to bottom edge 15 of bottom panel 11. More preferably, stitching 35 runs along the entire bottom edges 15 and 22 connecting said edges 15 and 22 together. Stitching 35 also may run along side edges 23, 24 of top panel 18 and connect said side edges 23, 24 to a portion of respective side edges 16, 17 of lower portion 25 of bottom panel 11.

As clearly seen in FIG. 1, the positioning of top panel 18 to lower portion 25 of bottom panel 11 forms pocket 26. Pocket 26 is designed for placement therein of one or more remote control devices 27. That is, pocket 26 functions to receive and store one or more remote control devices 27.

As depicted in FIG. 1, pocket 26 may be divided into two or more separate compartments or pockets. These separate compartments or pockets may receive and store individual remote control devices 27. The number and size of the separate components or pockets may vary according to design parameters and manufacturer or customer choice. However, it is preferred if remote control caddy 10 has three separate compartments of variable sizes. For example, remote control caddy 10 may have two smaller compartments or pockets and one larger compartment or pocket. The dimensions of each of the smaller compartments or pockets may be about half of the dimension of the larger component or pocket. Alternatively, remote control caddy 10 may have four separate components or pockets of equal dimensions.

Again with reference to FIG. 1, pocket 26 may be divided into two or more separate components or pockets by various procedures. For example, the separate components or pockets may be formed in remote control caddy 10 by stitching 34. Stitching 34 may be vertically disposed in a discrete region running from bottom edges 15, 22 to top edge 21 of top panel 18. Stitching 34 connects top panel 18 to bottom panel 11 within the aforesaid discrete region thereby forming divisions in pocket 26 to create said separate components or pockets. It is to be understood that other methods of forming the separate components or pockets may be utilized, as for example, by stapling or by gluing top panel 18 to bottom panel 11 in the aforesaid discrete regions.

FIG. 1 also shows that remote control caddy 10 may have attachment means 28 disposed at top portion 29 of bottom panel 11. Attachment means 28 may be any mechanism which will detachably affix remote control caddy 10 to sofa or chair 30. Such attachment means 28 may included the use of "VELCRO" straps. Mating straps may be disposed on the outer surface of bottom layer 13 of bottom panel 11 and on the area of the sofa or chair 30 in which placement of remote control caddy 10 is desired. For decorative purposes, it is preferred to use two or more upholstery twist pins 41. Upholstery twist pins 41 are commercially available from a variety of sources, such as Dyno Merchandise of Pompano Beach, Fla., which company distributes upholstery twist pins 41 under the trademark "SIMPLICITY." Preferably, two or three upholstery twist pins 41 are utilized to detachably secure remote caddy 10 to sofa or chair 30. Upholstery twist pins 41 may be positioned at opposite ends (and in the center if a third twist pin 41 is used) of top edge 14 of bottom panel 11 whereupon they are manually manipulated to detachably affix remote control caddy 10 to sofa or chair 30. That is, a force may be manually applied to each upholstery twist pin 41 to screw upholstery twist pins 41 into bottom panel 11 at or near top edge 14 and into the fabric covering sofa or chair 30. In this fashion, remote control caddy 10 is secured to sofa or chair 30.

Figure 2:
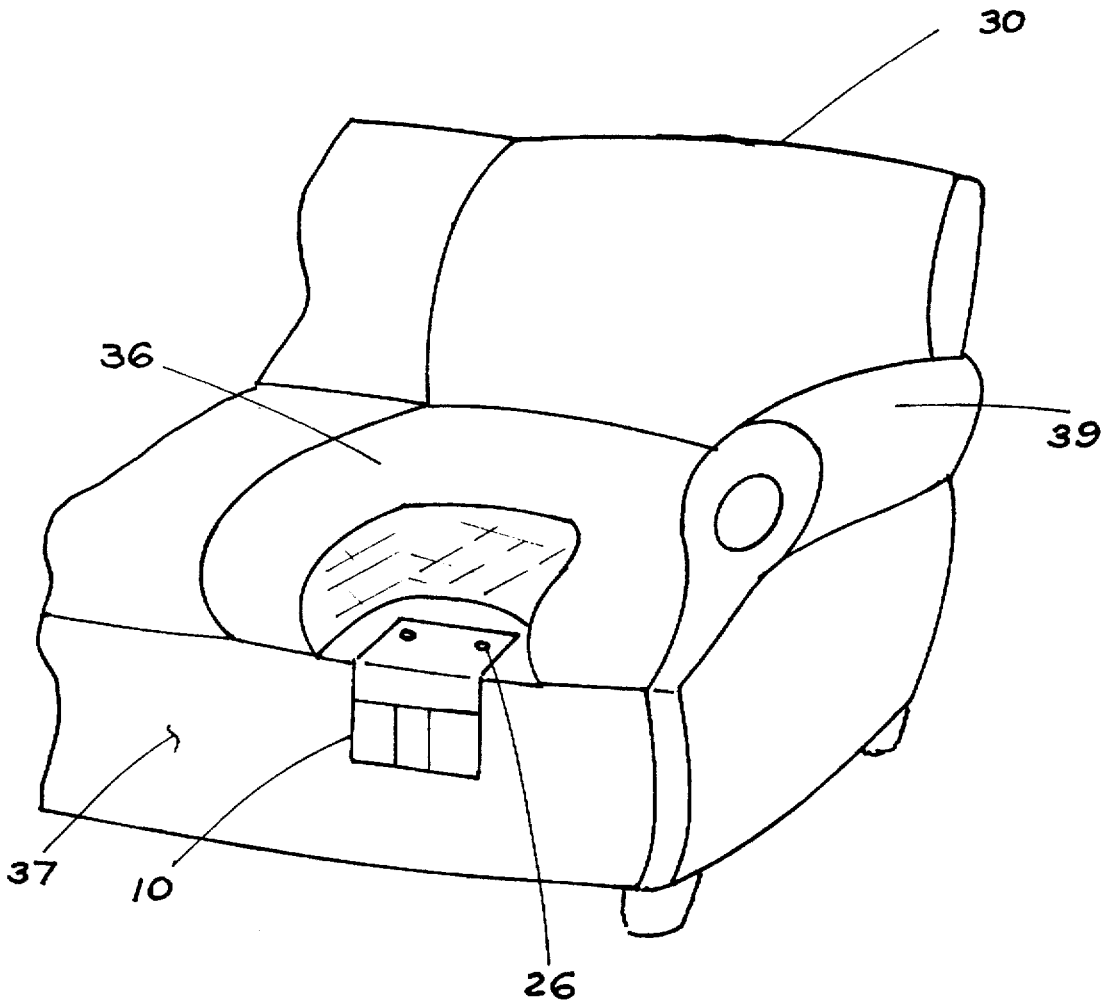
FIG. 2 is a cut-away, isometric view of one embodiment of the remote control caddy of the present invention positioned on the seat of a sofa.
Figure 3:
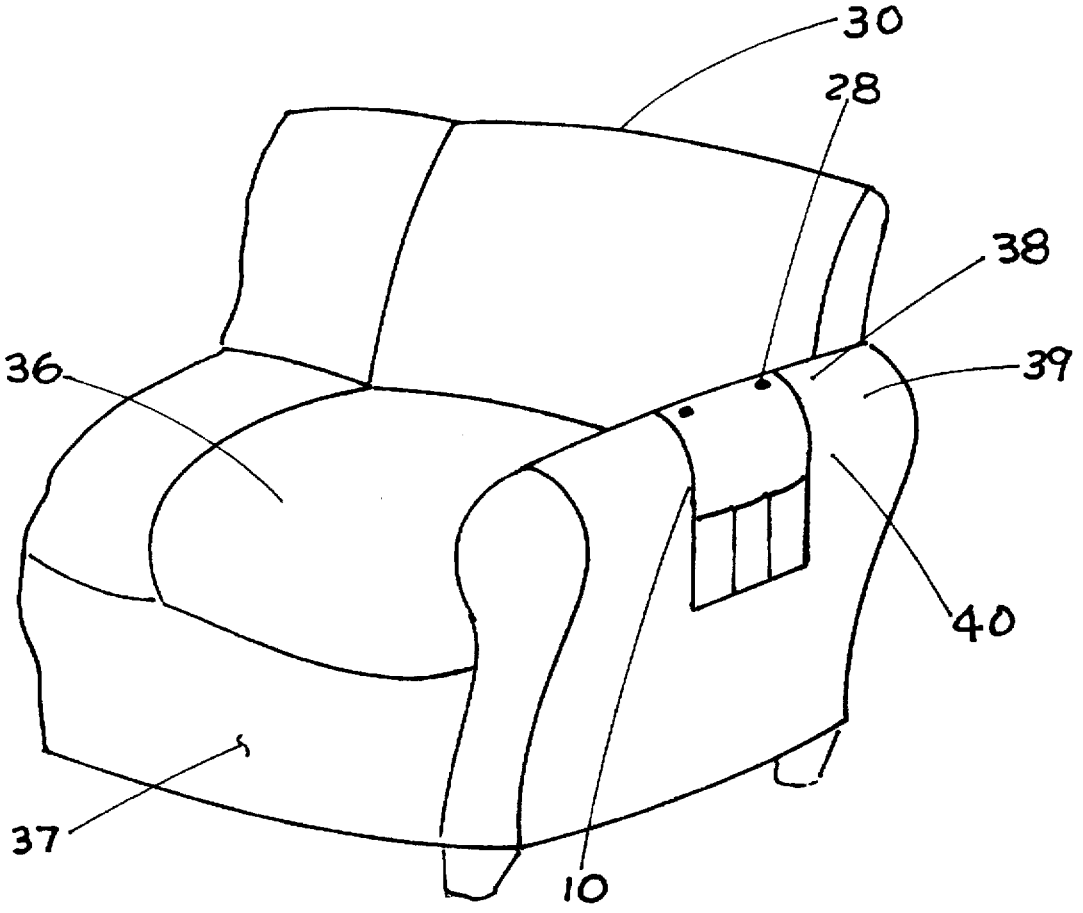
FIG. 3 is an isometric view of one embodiment of the remote control caddy of the present invention positioned on the arm of a sofa.

The preferred positioning of remote control caddy 10 is depicted in FIGS. 2 and 3. As can be seen in these figures, remote control caddy 10 may be positioned either under cushion 36 of sofa or chair 30 or over arm 39 of sofa or chair 30. In the first embodiment, top portion 29 of bottom panel 11 is substantially disposed under cushion 36 of sofa or chair 30. Attachment means 26 detachably affix top portion 29 of bottom panel 11 to the seat portion of sofa or chair 30. Lower portion 25 of bottom panel 11, together with top panel 18, preferably hangs downward, substantially perpendicular to top portion 25 and substantially parallel and adjacent to skirt 37 of sofa or chair 30. In the second embodiment, top portion 25 of bottom panel 11 is substantially disposed on top portion 38 of arm 39. Attachment means 28 detachably affix top portion 29 of bottom panel 11 to top portion 38 of arm 39. Lower portion 25 of bottom panel 11, together with top panel 18, preferably hangs downward, substantially parallel and adjacent to outer side 40 of arm 39.

It is preferred if top layer 12 of bottom panel 11 and top layer 19 of top panel 18 be made of upholstery fabric material. However, other fabric material may be utilized, as for example, a medium to heavy weight fabric material. Bottom layer 13 of bottom panel 11 and bottom layer 20 of top panel 18 are preferably a made of a lining weight fabric. The upholstery fabric material forming top layer 12 of bottom panel 11 and top layer 19 of top panel 18 may be the same material or different. Preferably, top layer 12 and top layer 19 are made of the same upholstery fabric material. Such material may be of a neutral color so as not to contrast with the fabric material covering sofa or chair 30. More preferably, top layer 12 and top layer 19 are made of the same upholstery material as that which covers sofa or chair 30.

In an alternative embodiment of remote control caddy 10 as illustrated in FIGS. 1 and 4, remote control caddy 10 may have a substantially cylindrically shaped cording material 31 disposed along top edge 21 of top panel 18. Cording material 31 is commercially available in most fabric shops and is composed of a mass of cotton fibers surrounded by a cylindrical webbing of intertwined threads. It is preferred if cording material 31 is disposed along the entirety of top edge 21 of top panel 18.

Preferably, cording material 31 is encased within sheath 32. Even more preferred, sheath 32 completely encases cording material 31. Sheath 32 may be made of any type of fabric material, either light, medium or heavy weight fabric material. Preferably, sheath 32 is made of a medium weight upholstery fabric material. Sheath 32 may also have a lip portion 33 which is stitched to top edge 21 of top panel 18. Preferably, the stitching runs along the entirety of top edge 21. More preferably, lip portion 33 is stitched between top layer 19 of top panel 18 and bottom layer 20 of top panel 18.

Figure 5:
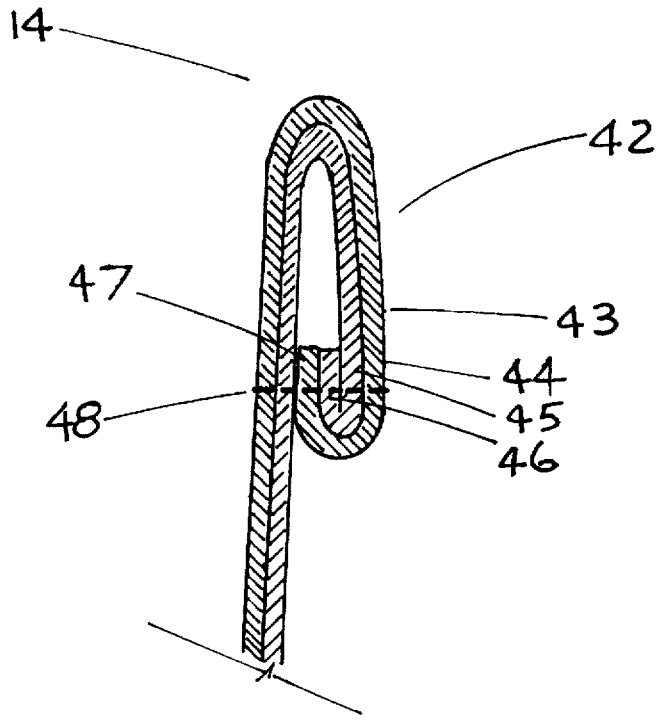
FIG. 5 is partial cross sectional view of one embodiment of the remote control caddy of the present invention taken along line 2—2 of FIG. 1 showing the placement and construction of the reinforced region.
Figure 7:
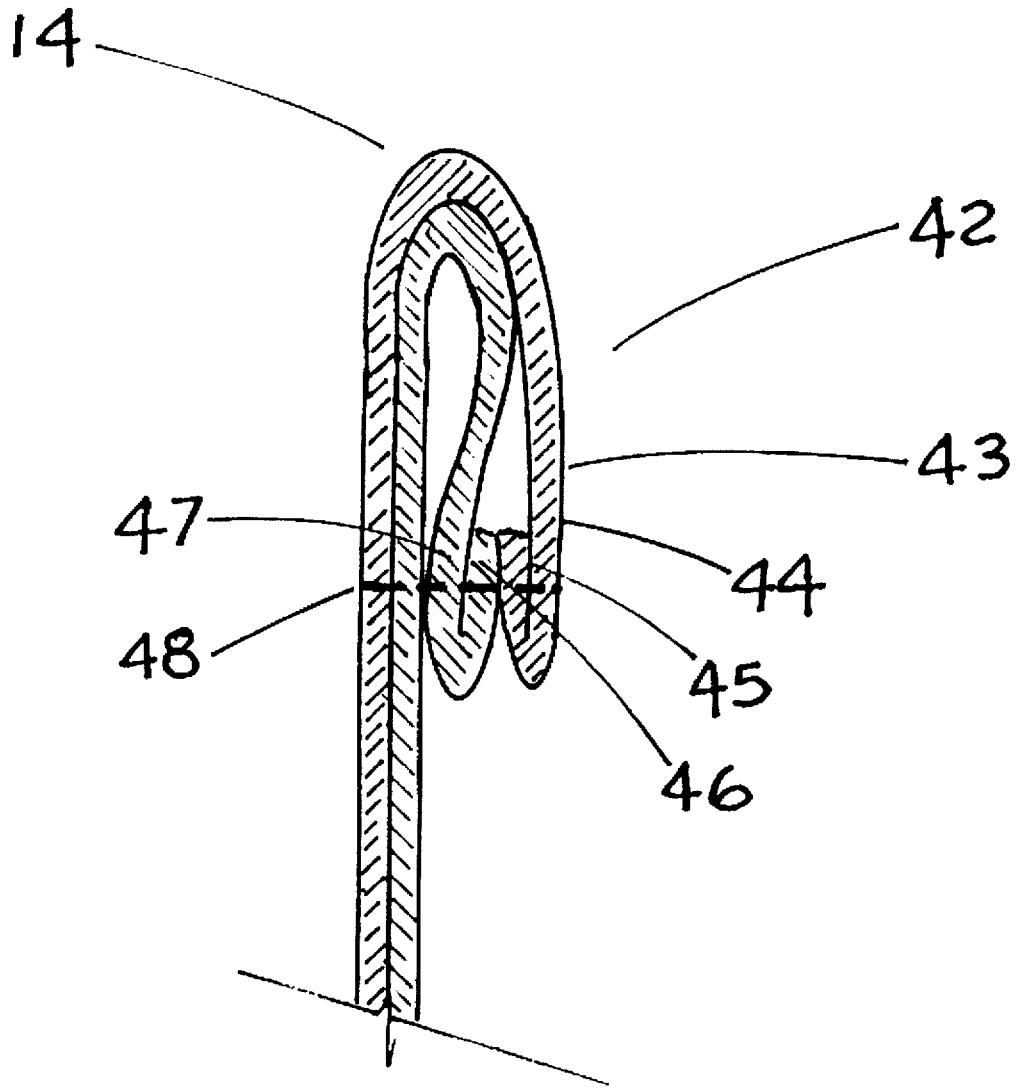
FIG. 7 is a partial cross sectional view of an alternative embodiment of the reinforced region of the remote control caddy of the present invention.

In an alternative embodiment of remote control caddy 10, bottom panel 11 may have a reinforced region 42 as seen in FIGS. 5 and 7. Reinforced region 42 may be disposed at and form top edge 14 of bottom panel 11. As illustrated in FIG. 5, reinforced region 42 may be a folded portion 43 of bottom panel 11 in which case it may have a bottom layer of upholstery fabric material 44, two inner layers of upholstery fabric liner 45, 46 and a top layer of upholstery fabric material 47. FIG. 7 shows another embodiment in which reinforced region 42 may be a folded portion 43 of bottom panel 11 in which case it may have a bottom layer of upholstery fabric material 44, two inner layers 45, 46 (inner layer 45 being made of upholstery fabric material and inner layer 46 being made of upholstery fabric liner) and a top layer of upholstery fabric liner 47. Stitching 48 may run along edges 49 of reinforced region 42 and through folded portion 43 of bottom panel 11. In other words, stitching 48 connects the aforesaid layers 44–47 together. In this configuration, top edge 14 of bottom panel 11 is formed by reinforced region 42. Top edge 14 is created when the upper portion of bottom panel 11 is folded over onto itself to form folded portion 43. Attachment means 28 are preferably disposed within reinforced region 42.

Figure 6:
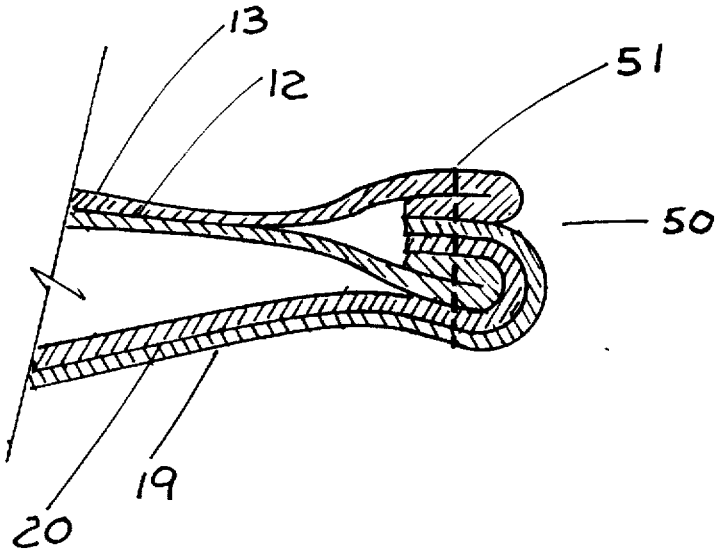
FIG. 6 is a cross sectional view of one embodiment of the remote control caddy of the present invention taken along line 3—3 of FIG. 1 showing the reinforced edging.

Although not necessary, the construction of remote control caddy 10 may be further strengthened by reinforcing edges 14–17 of bottom panel 11 and edges 21–24 of top panel 18, as seen in FIG. 6. Said edges 14–17 and 21–24 may be reinforced by folding over a small portion 50 of the top and bottom panels 11, 18 onto themselves along and in a discrete area about said edges 14–17 and 21–24. This folding serves to create double layered edging throughout remote control caddy 10. Stitching 51 is provided through said doubled layered edging or small folded portion 50.

While it is to be understood that remote control caddy 10 may be a varying sizes, it is preferred if remote control caddy 10 has the overall dimensions of 13½ inches by 13½ inches in the embodiment designed to attach to the seat of sofa or chair 30. Bottom panel 11 preferably has the same dimensions. Top panel 18 is preferably about half the size of bottom panel 11. More preferably, top panel 18 is about 6 inches in width and 13½ inches in length. In the embodiment of remote control caddy 10 which is designed for attachment to arm 39, the overall dimensions are preferably, 13½ inches by 26 inches.

Remote control caddy 10 may be made by providing bottom panel 11 having top layer 12 of upholstery fabric material and bottom layer 13 of fabric liner. Bottom panel 11 may conform generally to a shape of a rectangle or square having top edge 14, bottom edge 15 and side edges 16, 17. Top panel 18 may also be provided which has top layer 19 of upholstery fabric material and bottom layer 20 of fabric liner. Top panel 18 may conform generally to a shape of a rectangle or square having top edge 21, bottom edge 22 and side edges 23, 24. Top panel 18 may be secured to lower portion 25 of bottom panel 11 along bottom edge 15 thereof, preferably, along the entire bottom edge 15. Top panel 18 may also be secured partially along side edges 16, 17 of bottom panel 11. By securing top panel 18 as aforesaid, top panel 18 forms a pocket for the placement therein of one or more remote control devices 27. Attachment means 28 may also be provided and may be disposed at top portion 29 of bottom panel 11 for detachably securing remote control caddy 10 to sofa or chair 30.

While remote control caddy 10 may be constructed by a number of methods, it is preferred if the following method is undertaken. First, top layer 12 and bottom layer 13 are cut from their respective fabrics (upholstery fabric material for top layer 12 and fabric liner for bottom layer 13) in the sizes previously discussed herein for the particular embodiment of the remote control caddy desired to be made. Hence, the top and bottom layers 12, 13 of the first embodiment may be cut in the dimensions 13½ by 13½ inches or said top and bottom layers 12, 13 may be cut in the dimensions 13½ by 26 inches. Second, top layer 19 and bottom layer 20 are cut from their respective fabrics (upholstery fabric material for top layer 19 and fabric liner for bottom layer 20) such that they are six inches wide and 13½ inches long. Third, cording material 31 is obtained in the length of 13½ inches. Bottom layer 20 is then placed on the underside of top layer 19 to form top panel 18. Cording material 31, encased within sheath 32, is placed along top edge 21 of top panel 18 such that lip portion 33 is disposed between top layer 19 and bottom layer 20 and pinned thereto. Top panel 18 is turned inside out and top stitched along top edge 21, through lip portion 33. Next, bottom layer 13 is placed on the underside of top layer 12. Top panel 18 is then placed on lower portion 25 of bottom panel 11 such that bottom edge 22 of top panel 18 and bottom edge 15 of bottom panel 11 are aligned. The respective bottom and side edges 15–17 and 22–24 of bottom and top panels 11, 18 are stitched, leaving top edge 14 of bottom panel open. The corners formed by bottom edges 15, 22 are clipped to prevent bulking and said corners are finished.

Remote control caddy 10 is then turned inside out. Top edge 14 is turned in and pinned. About 1 inch of top edge 14 is folded onto itself to create reinforced region 42 and is then stitched. All sides or edges of reinforced region 42 are top stitched for a clean finish. Finally, separate compartments or pockets are formed in top panel 18 by top stitching (e.g., at two or three points).

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

What is claimed is:

1. A remote control caddy comprising:

a bottom panel having a top layer of upholstery fabric material and a bottom layer of fabric liner and conforming generally to a shape of a rectangle to provide top, bottom and side edges:

a top panel having a top layer of upholstery fabric material and a bottom layer of fabric liner and conforming generally to a shape of a rectangle having a top, bottom and side edges;

said top panel being secured to a lower portion of said bottom panel along said entire bottom edge and partly along said side edges thereof to form two or more pockets for placement of one or more remote control devices therein;

attachment means disposed at a top portion of said bottom panel for detachably securing said caddy to a sofa or chair and wherein said attachment means are two or more upholstery twist pins;

a clindrically shaped cording material encased within a sheath of upholstery fabric material which is disposed along the entire top edge of said top panel;

and wherein a lip portion formed by said sheath of upholstery fabric material is stitched to said entire top edge of said top panel, and wherein said lip portion is stitched between said top layer of upholstery fabric material and said bottom layer of said fabric liner;

and wherein said separate pockets are formed by stitching in said remote control caddy, said stitching being vertically disposed from said bottom edge of said top and bottom panels to said top edge of said top panel.

2. The remote control caddy according to claim 1, wherein said top portion of said bottom panel is substantially disposed under a cushion of said sofa or chair and said lower portion of said bottom panel, together with said top panel, hangs downwardly and adjacent to a skirt of said sofa or chair.

3. The remote control caddy according to claim 1, wherein said top portion of said bottom panel is substantially disposed on a top portion of an arm of said sofa or chair and said lower portion of said bottom panel, together with said top panel, hangs downwardly and adjacent to an outer side of said sofa arm or chair.

4. The remote control caddy according to claim 1, wherein said attachment means are two upholstery twist pins each disposed at opposite ends of said top edge of said bottom panel.

5. A remote control caddy comprising:

a bottom panel having a top layer of upholstery fabric material and a bottom layer of fabric liner and conforming generally to a shape of a rectangle to provide top, bottom and side edges;

said bottom panel having a reinforced region disposed at and forming said top edge of said bottom pane, said reinforce region being a folded portion of said bottom panel having a bottom layer of upholstery fabric material, two inner layers of upholstery fabric liner and a top layer of upholstery fabric material and stitching along edges of said reinforcing region through said folded portion of said bottom panel;

a top panel having a top layer of upholstery fabric material and a bottom layer of fabric liner and conforming generally to a shape of a rectangle having a top, bottom and side edges and wherein said edges of said top and bottom panels are reinforced by folding a small portion of the respective top and bottom panels onto themselves along said edges and providing stitching through said folded portions;

a cylindrically shaped cording material encased within a sheath of upholstery fabric material which is disposed along the entire top edge of said top panel, said sheath of upholstery fabric having a lip portion which is stitched between said top layer of upholstery fabric material and said bottom layer of said fabric liner;

said top panel being stitched to a lower portion of said bottom panel along said entire bottom edge and partly along said side edges thereof to form two or more pockets for the placement of one or more remote control devices therein, and wherein said separate pockets are formed by stitching said top panel to said bottom panel, said stitching being vertically disposed from said bottom edge of said top and bottom panels to said top edge of said top panel; and attachment means disposed at said reinforced region of said bottom panel for detachably securing said caddy to a sofa or chair, and wherein said attachment means are two upholstery twist pins each disposed at opposite ends of said top edge of said bottom panel in said reinforced region.

* * * * *